US005931532A

United States Patent [19]

Kemmerer et al.

[11] Patent Number: 5,931,532

[45] Date of Patent: Aug. 3, 1999

[54] LIFT RECLINER CHAIR WITH SAFETY SYSTEM

[76] Inventors: Kenneth Kemmerer, 1 Copley Pl., Laurel Lakes Village, Pa. 18707; Kenneth Casey, 50 Deer Run Rd., Plymouth Township, Pa. 18651

[21] Appl. No.: 08/790,861

[22] Filed: Feb. 3, 1997

[51] Int. Cl.[6] ..... A47C 1/02

[52] U.S. Cl. ..... 297/330; 297/325; 297/DIG. 10; 297/344.17

[58] Field of Search ..... 297/330, 325, 297/DIG. 10, 85, 68, 463.2, 344.17

[56] References Cited

U.S. PATENT DOCUMENTS

| | | | |
|---|---|---|---|
| 3,698,673 | 10/1972 | Olsen | 297/330 X |
| 4,007,960 | 2/1977 | Gaffney | 297/330 X |
| 4,083,599 | 4/1978 | Gaffney | 297/330 X |
| 4,407,030 | 10/1983 | Elliott | 5/66 |
| 4,786,107 | 11/1988 | Crockett | 297/330 |
| 4,852,939 | 8/1989 | Krauska | 297/330 X |
| 4,946,222 | 8/1990 | Matson | 297/325 X |
| 4,993,777 | 2/1991 | La Pointe | 297/325 |
| 5,024,486 | 6/1991 | Auel | 297/330 |
| 5,061,010 | 10/1991 | La Pointe | 297/330 X |
| 5,076,644 | 12/1991 | Northcutt | 297/330 |
| 5,136,889 | 8/1992 | Hill et al. | 297/330 X |
| 5,165,753 | 11/1992 | Henderson | 297/330 |
| 5,265,935 | 11/1993 | Geisler et al. | 297/330 X |
| 5,294,179 | 3/1994 | Rudes et al. | 297/325 X |
| 5,314,238 | 5/1994 | Komorowski et al. | 297/330 X |
| 5,520,439 | 5/1996 | Blount | 297/330 |
| 5,641,201 | 6/1997 | Casey et al. | 297/DIG. 10 X |
| 5,651,580 | 7/1997 | La Pointe et al. | 293/330 X |

FOREIGN PATENT DOCUMENTS

| | | | |
|---|---|---|---|
| 2933093 | 2/1981 | Germany | 297/330 |
| 3003423 | 8/1981 | Germany . | |
| 60-94840 | 5/1985 | Japan | 297/330 |
| 61-37546 | 2/1986 | Japan | 297/330 |
| 61-37549 | 2/1986 | Japan | 297/330 |

*Primary Examiner*—Jose V. Chen
*Assistant Examiner*—Rodney B. White

[57] ABSTRACT

A power operated lift recliner which includes a safety system which senses the presence of an object located between a raised chair and the base frame and deactivates the power lift mechanism to prevent the mechanism from lowering the chair toward the base onto the object located therebetween.

13 Claims, 2 Drawing Sheets

LIFT RECLINER CHAIR WITH SAFETY SYSTEM

BRIEF DESCRIPTION OF INVENTION

This invention relates to power operated lift recliner chairs and more particularly to a lift recliner chair including a safety switch system adapted to deenergize the lift motor when an obstacle is present underneath the chair as the chair is being lowered from a raised to a seated position.

Power operated lift recliner chairs are commonly used by persons needing assistance in transferring from a seated position to a standing position. Such chairs include a power operated lift mechanism which raises the chair and tilts it forwardly to being its occupant to a standing position and in reverse lowers the occupant from a standing to a seated position. The chairs also shift rearwardly to one or more reclining rest positions. U.S. Pat. Nos. 4,007,960, 4,083,599 and 4,993,777 illustrate various prior lift chairs and their operating lift mechanisms. Lift chairs of this general type are well known and are sold commercially by American Dream International, Inc. of Larksville, Penn., and by others.

Conventional lift chairs usually include a base in the form of a steel frame which rests on a floor, a chair and an electrically operated lift mechanism which mounts the chair on the base and operates to power the chair between a reclining position, a seated position and a raised inclined position. When the chair is in a raised position there is a substantial open space between the bottom of the chair, the components of the lift mechanism, and the base frame. Some concern has been expressed regarding possible injury to an object such as a child or animal that might become positioned in the space between the base and the raised chair without the knowledge of the occupant of the chair, as the chair is lowered from its raised position to a seated position. As the chair is lowered under power the child or animal may be squeezed between the moving and stationary parts of the chair and frame and may be severely injured.

This potential problem, regardless of how minimal the risk, needs to be addressed and avoided and the invention described hereinbelow provides a solution to that problem.

SUMMARY OF THE INVENTION

Accordingly the primary purpose of this invention is to provide a novel lift recliner which includes a safety system which senses the presence of an object located between a raised chair and the base frame and deactivates the power lift mechanism to prevent the mechanism from lowering the chair toward the base onto the object located therebetween.

A further object of the invention resides in the provision of the above novel lift recliner wherein the sensing system includes reset circuitry which must be first actuated before the chair can again be moved in a downward direction, thus insuring that the obstacle between the chair and the base is removed before the chair is again lowered.

Still another object of the invention resides in the provision of the above novel lift recliner wherein the novel safety system adds minimal cost to the recliner.

Other objects and advantages of the invention will become apparent from reading the following detailed description of the invention wherein reference is made to the accompanying drawings.

DETAILED DESCRIPTION OF THE INVENTION

Figure 1:
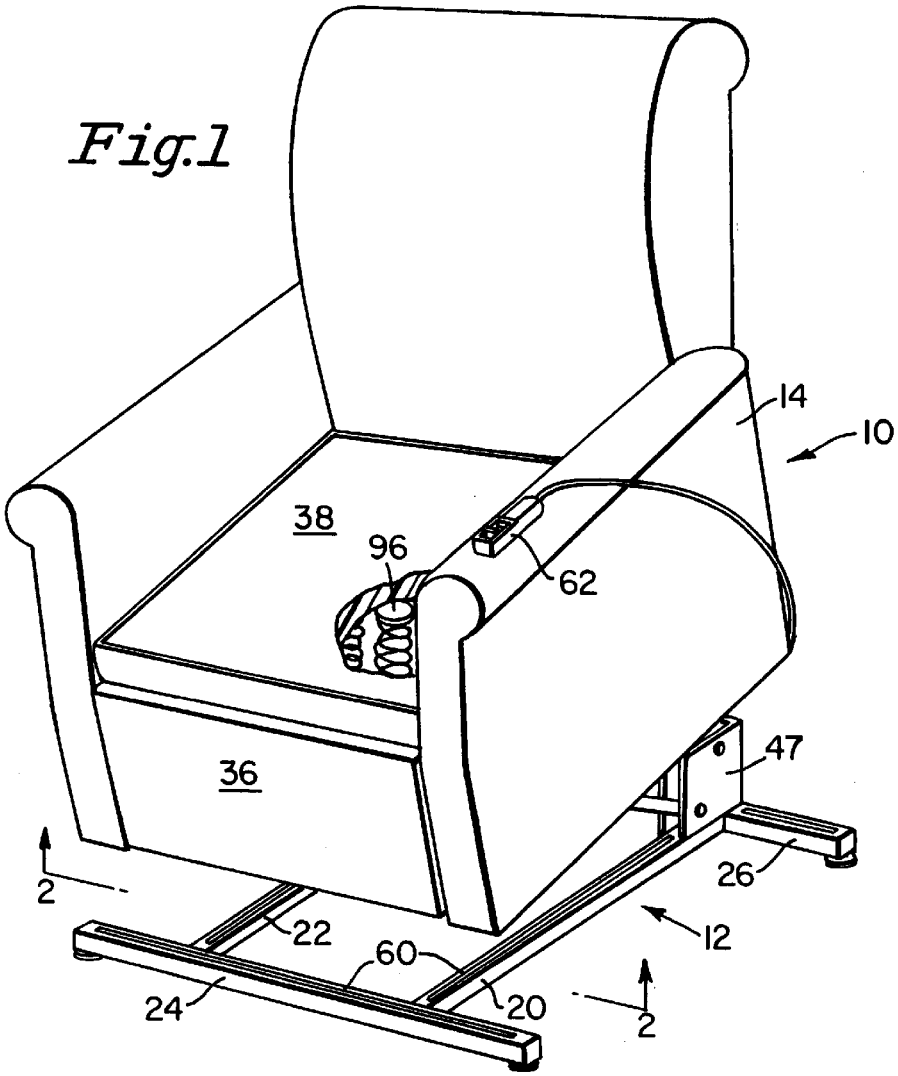
FIG. 1 is a front perspective view of the lift recliner incorporating the safety system of the invention.

Referring now to the drawings, the novel lift recliner 10 includes a base 12 adapted to rest on the floor, a chair 14 and an electric motor operated lift and recline mechanism 16 supporting the chair 14 from base 12.

Base 12 is a metal weldment formed from rectangular tubing and including a pair of laterally spaced rectangular side elements 20 and 22 welded to front and rear tubular pieces 24 and 26, respectively, to form a generally rectangular base support.

Figure 3:
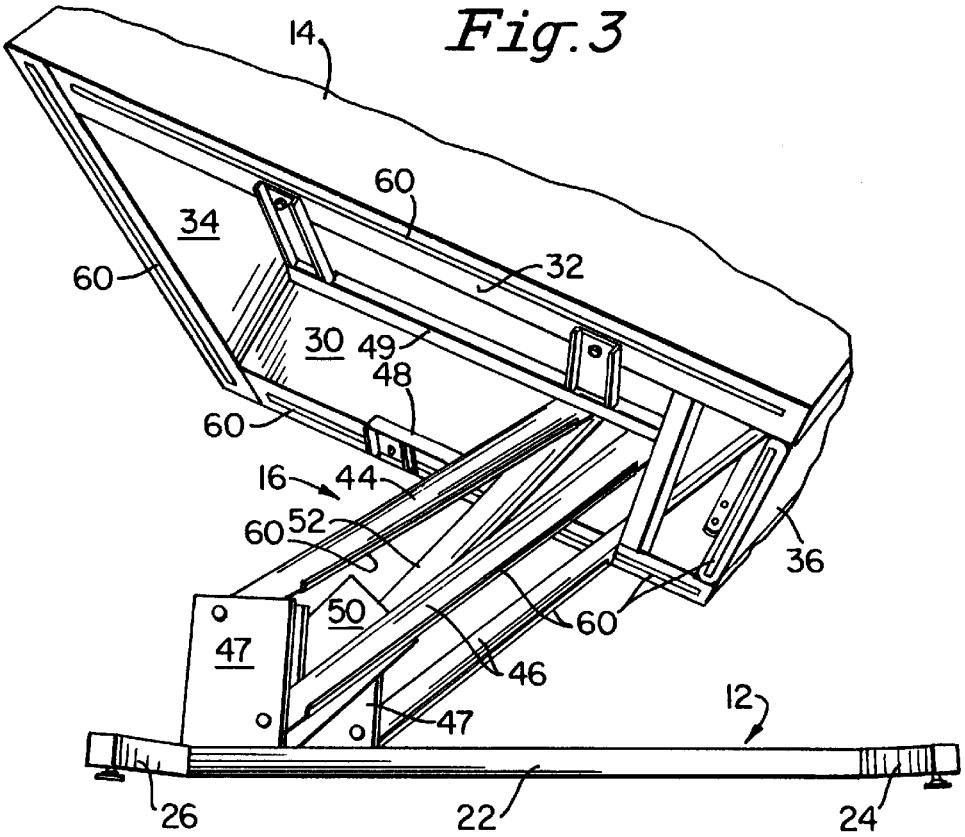
FIG. 3 is a fragmentary side perspective view illustrating the bottom of the chair, the motor operated lift mechanism, and the base.

The bottom of chair 14 includes a generally U-shaped wooden frame including laterally spaced side members 30 and 32 and a rear member 34 connected to the side members. A foot rest 36 is pivotally mounted at the front of chair 14 below seat 38 for movement between a vertical position shown in FIGS. 1 and 3 to a horizontal position when the chair is moved rearwardly to a reclining position. As shown in FIG. 3 the wooden frame members 30, 32 and 34 and footrest 36 form the bottom perimeter of chair 14 and define a hollow space underneath the bottom of seat 38.

Lift mechanism 16 includes a pair of laterally spaced lift arm assemblies 40 and 42 each including upper and lower rectangular tubular arms 44 and 46 pivotally attached at their rearward ends to brackets 47 which are welded to frame 12 on top of tubular members 20, 22 and 26. The forward ends of arms 44 and 46 are pivotally connected to metal frames 48 and 49 which are attached respectively to the wooden frame members 30 and 32 of chair 14. A reversible electric motor 50 is pivotally attached to rear cross member 26 of base 12 and has a forwardly extending screw and lift tube assembly 52 which pivotally connects at its forward end via bracket 53 and cross members 54 and 55 to arm assemblies 40 and 42 and frame assemblies 48 and 50 and to suitable linkage connected to footrest 36 to raise, or lower the chair as motor 50 is rotated in one direction or the other. In FIGS. 1 and 3 chair 14 is shown positioned in a raised and forwardly tilting position to assist the occupant in getting up to a standing position. The chair is lowered to a horizontal seating position and then reclined to a horizontal resting position with footrest 36 extended in a horizontal position by reversing motor 50 and retracting mechanism 52.

The lift recliner 10 and its operation described thusfar is all conventional and those in the industry are very familiar with the detailed construction and operation of such chairs.

As mentioned hereinabove when the chair 14 is in a raised position such as that shown in FIGS. 1 and 3, an open space exists between the top of base 12 and the bottom of chair 14 and the various operating arms and components of lift mechanism 16. If a child should become positioned within that space and the occupant of the chair is unaware of his presence, as the chair is lowered from the raised position to the seated position the child may be injured. For example, should a child's hand or body be trapped between the bottom of frame members 30, 32 or 34 and base 12, or the bottom of arms 44 and 46 and base 12, severe injury may occur as motor 50 continues to run and the chair and mechanism 16 continue to be lowered.

Figure 2:
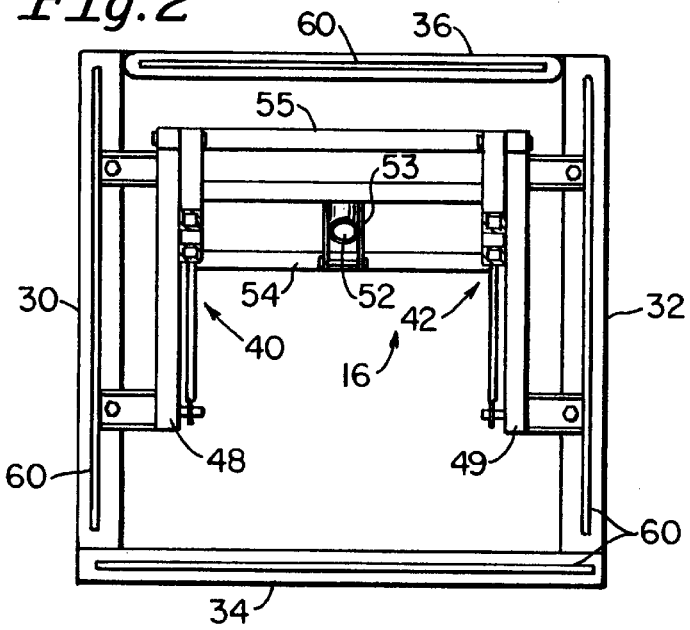
FIG. 2 is a bottom view of the chair and the motor operated lift mechanism taken along line 2—2 of FIG. 1.
Figure 4:
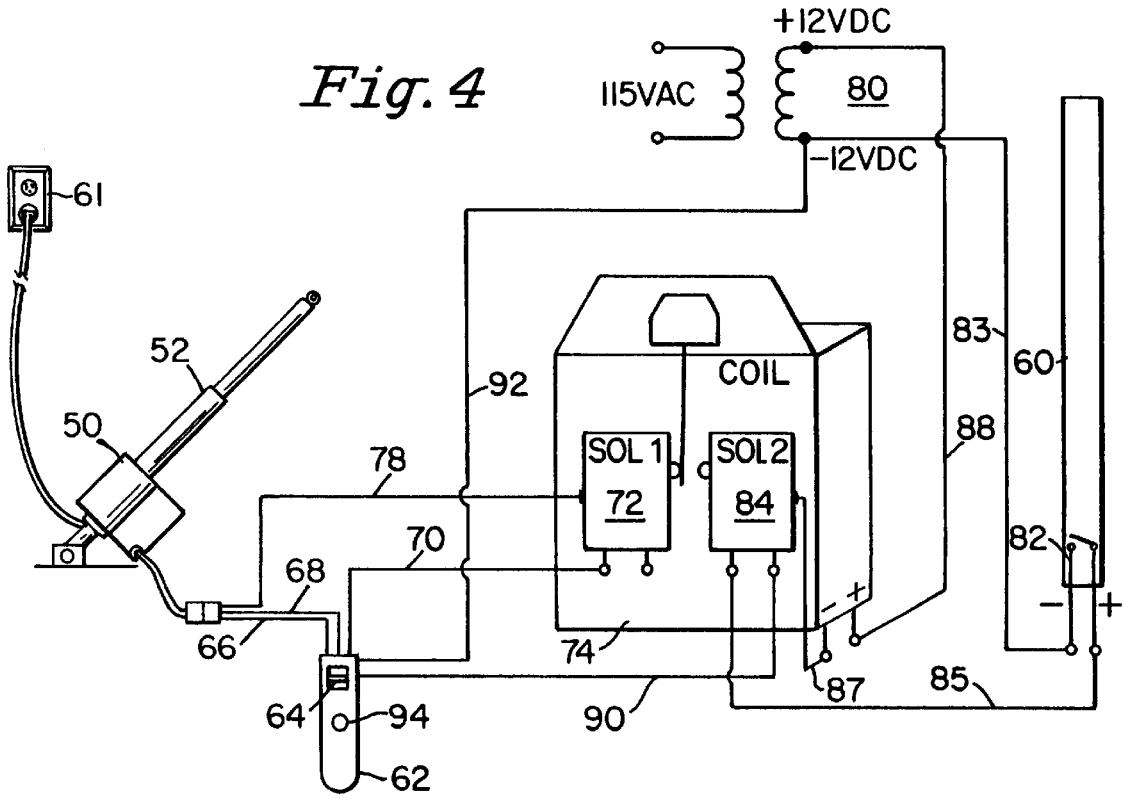
FIG. 4 is a electrical schematic of the circuitry for controlling operation of the motor operated lift mechanism.

The invention provides a safety system which automatically senses the presence of a child or other object within that space and deenergizes the motor 50 to stop any further downward movement of chair 14 or mechanism 16 thereby preventing injury to the child. The sensing system may include any type of suitable sensing elements but preferably is formed by a plurality of pressure sensitive ribbon sensing switches in the form of strips or tapes 60 mounted on the bottom facing surfaces of the wooden frame members 30, 32 and 34 of chair 14, the bottom surface of footrest 36, the bottom surfaces of arms 44 and 46, and the top surfaces of frame members 20, 22, 24 and 26. These ribbon sensing switches are readily available commercially from suppliers such as Tapeswitch Corporation of Farmingdale, N.Y. As is evident in FIGS. 1–3 of the drawings, the ribbon switches 60 extend along substantially the full length of the various members on which they are applied thereby protecting the entire vertical space or envelope defined by the outer perimeter of frame members 30, 32, 34, footrest 36 and the outer extremes of base members 24 and 26 of base 12. Sensors 60 are extremely pressure sensitive and a slight touch by a child on any one of the sensors will cause motor 50 to be deenergized by suitable electrical circuitry such as that illustrated in FIG. 4. Motor 50 is powered from a conventional 115 volt a.c. house supply system 61 and is operated by a suitable hand control 62 provided with an actuator switch 64 having up or down positions to rotate motor 50 in one direction or another to extend or retract actuator unit 52 and thereby raise or lower chair 14 with respect to frame 12. Control 62 normally provides current to motor 50 by way of lines 66, 68 and line 70 which is connected to a first microswitch 72 of a relay coil 74 operated by a 12 volt d.c. supply 80 obtained through a suitable rectifier system from the conventional house power supply. Coil 74 is normally deenergized and arm 76 maintains microswitch 72 in a closed condition so that current can flow from line 70 through switch 72 to line 78 to motor 50, thus causing motor 50 to rotate in one direction or another depending upon the up or down position of switch 64. The sensor switches 60 are operated from the 12 volt d.c. supply 80. Each of the sensors 60 includes a microswitch 82 which is closed when the sensor is touched to supply d.c. current to coil 74 via lines 83, 85, 87 and 88, thereby energizing the coil to move arm 76 out of engagement with microswitch 72 and into engagement with microswitch 84. This stops the flow of a.c. current from line 70 to line 78 and thus deenergizes motor 50, stopping downward movement of chair 14 and the components of lift mechanism 16. The child or other object which is within the vertical space or envelope between the chair and base can then be removed before any injury occurs. When the child is removed, coil 74 remains energized via lines 90 and 92 and a normally closed reset button switch 94 on hand control 62. Thus, it is necessary for the occupant of the chair to push reset button 94 to interrupt current flow between lines 90 and 92, and thereby deenergize coil 74. Arm 76 will reengage and close microswitch 72 and in this way permit motor 50 to again be energized for up or down operation by the occupant upon proper actuation of finger switch 64.

Other types of sensor switches may be employed instead of the pressure sensitive switches 60. For example, light sensitive strips may be used to provide a curtain of light around the space defined by the perimeter of the bottom of the chair and top of the base frame. When an object breaks the curtain of light motor 50 will be deenergized. For some applications, a motion sensor 96 pivotally mounted underneath seat 38 as shown schematically in FIG. 1 and capable of emitting a wide conical beam downwardly within the envelope of the chair may be satisfactory. Similarly, other suitable circuitry for resetting the electrical system may be used, e.g. instead of manually resetting motor 50 it may be automatically reversed to raise the chair.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. Seating apparatus comprising a chair having a bottom, a base frame supported from a floor, a lift mechanism mounting said chair on said base frame and including motor means to move said chair between a seating position and a raised forward tilting position in which the bottom of said chair and said base frame define an open space therebetween, and electrical control means for controlling operation of said motor means and including sensing means actuatable in response to the presence of an object within said space to disable said motor means and thereby prevent said motor means from lowering said chair toward said base frame, said sensing means operating substantially independently of any load imposed on said motor means as said motor means raises or lowers said chair.

2. Seating apparatus as defined in claim 1, said control means deenergizing said motor means and including reset circuit means which is actuated before said motor means can be energized to lower said chair.

3. Seating apparatus as defined in claim 2, said reset circuit means including a reset switch which is manually operated.

4. Seating apparatus as defined in claim 1, said control means including first pressure sensitive means mounted on the bottom of said chair and operable in response to a slight touch by said object to disable said motor means.

5. Seating apparatus as defined in claim 4, said control means including second pressure sensitive means mounted on said base frame and operable in response to a slight touch by said object to disable said motor means.

6. Seating apparatus as defined in claim 1, said control means including pressure sensitive means mounted on said base frame and operable in response to a slight touch by said object to disable said motor means.

7. Seating apparatus as defined in claim 1, said control means including reset circuit means which is actuated before said motor means can lower said chair.

8. Seating apparatus as defined in claim 7, said reset circuit means including a reset switch which is manually operated.

9. Seating apparatus as defined in claim 7, said reset circuit means including means for automatically reversing said motor means to raise said chair.

10. Seating apparatus comprising a chair having a bottom including a periphery, a base frame supported from a floor, a lift mechanism mounting said chair on said base frame and including motor means to move said chair between a seating position and a raised position in which the bottom of said chair and said base frame define an open space therebetween, and electrical control means for controlling operation of said motor means and including strip sensing means mounted on the bottom of said chair and extending substantially around the periphery thereof said strip sensing means operable in response to the presence of an object within said space to disable said motor means and thereby prevent said motor means from lowering or raising of said chair.

11. Seating apparatus as defined in claim 10, said control means including second strip sensing means mounted on the top of said base frame.

12. Seating apparatus as defined in claim 11, said first and second strip sensing means being pressure sensitive switches operable in response to a slight touch by said object to disable said motor means.

13. Apparatus as defined in claim 10, said strip sensing means being pressure sensitive switches operable in response to a slight touch by said object to disable said motor means.

* * * * *